United States Patent [19]

Pickens, Jr. et al.

[11] 4,391,866

[45] Jul. 5, 1983

[54] CUT PILE FABRIC WITH TEXTURIZED LOOPS

[75] Inventors: Robert C. Pickens, Jr., Gurnee; Reese R. Thomas, Libertyville; Ronald Somerville, Gurnee, all of Ill.

[73] Assignee: Ozite Corporation, Libertyville, Ill.

[21] Appl. No.: 328,970

[22] Filed: Dec. 9, 1981

Related U.S. Application Data

[63] Continuation of Ser. No. 159,470, Jun. 16, 1980, abandoned.

[51] Int. Cl.[3] ..... B32B 3/02; B32B 33/00

[52] U.S. Cl. ..... 428/92; 156/72; 428/93; 428/94; 428/95; 428/97

[58] Field of Search ..... 428/85, 92, 93, 94, 428/95, 97

[56] References Cited

U.S. PATENT DOCUMENTS 3,152,381 10/1964 Priester ..... 428/91

3,867,243 2/1975 Stoller ..... 428/85

*Primary Examiner*—Marion McCamish

*Attorney, Agent, or Firm*—Wood, Dalton, Phillips, Mason & Rowe

[57] ABSTRACT

A novel cut pile fabric (10) and a method of making same is disclosed. The cut pile fabric (10) includes a needled non-woven batt (14) of staple fibers (12) that is processed on a texturizing needle loom (17) from one surface (20) (called a back surface) thereof to form texturized loops (18) on the other surface (22) (called a face surface) of said batt (14). The non-textured back surface (20) of the batt (14) has a backing (24) applied thereto which may be of latex, or the like, with the texturized loops (18) being tigered by a tigering roll (28) to cut, break or fracture a high percentage of the loops. The tigered pile is polished by a polishing roll (34) to remove the crimps in the fibers and to orient the fibers in a direction transverse to the batt (14) prior to being sheared in a shear (36). A dense, plush cut pile fabric is produced.

12 Claims, 9 Drawing Figures

CUT PILE FABRIC WITH TEXTURIZED LOOPS

This is a continuation, of application Ser. No. 159,470 filed June 16, 1978, now abandoned.

DESCRIPTION

1. Technical Field

This invention relates to a cut pile fabric and a method of making same and, more particularly, to a cut pile fabric made from a needled batt of non-woven stable fibers.

2. Background Art

There has been on the market for many years fabrics having a backing member, such as jute or burlap, or the like, which may or may not have a non-woven batt of staple fibers secured thereto as by the use of adhesive, needle bonding, fusion, or the like. Yarn is tufted through the backing and/or through the batt. The ends of the tufts are then napped, tigered, or cut to produce a fleece-like material, see U.S. Pat. No. 3,152,381 issued Oct. 13, 1964 to Priester et al and U.S. Pat. No. 2,913,803 issued Nov. 24, 1959 to Dodds, or a frieze effect material, see U.S. Pat. No. 3,341,386 issued Sept. 12, 1967 to White et al. All of this prior art has in common the use of tufting to provide looped pile, the loops of which are then napped or cut to produce the fabric having a deep soft surface thereon.

U.S. Pat. No. 3,674,618 issued July 4, 1972 to Spann discloses a process for making an imitation sliver knit pile fabric wherein a thin thermoplastic film is placed on a non-woven layer of stable fibers. The fibers are needled through the film and the film is thermally bonded to the fibers. The layer of fibers are then napped, sheared and polished to produce an apparel fabric that is soft and pliable.

U.S. Pat. No. 3,347,736 issued Oct. 17, 1967 to Sissons shows attaching a reinforcing member to a surface of a web of stable fibers. The web and reinforcing member are needle punched from the side of the web opposite the reinforcing member to force fibers through the reinforcing member to form fiber tufts. The resulting product is immersed in boiling water to crimp the fibers.

The present invention is directed to overcoming one or more of the problems inherent in the structures of the above fabrics.

DISCLOSURE OF INVENTION

A cut pile fabric and method of making same are provided that overcomes the problems and disadvantages of the prior art while producing an improved relatively deep and dense plush cut pile. The fabric is formed from a needled batt of non-woven staple fibers that is texturized through the batt from one surface to produce closely spaced loops of fibers from the other surface thereof. The batt is then backed by applying to said one surface a coating of latex, by fusing said one surface, or the like, to fix the fibers in the batt and in the spaced loops prior to tigering the loops. The tigering of the loops cuts, breaks or fractures the loops of fiber resulting in a lofted, dense cut pile. The tigered fibers are then polished to raise the fibers of the pile to a vertical orientation, to straighten the crimps in the fibers and to direct the lay of the pile. The polished fibers are sheared to the desired depth of pile resulting in a fabric having a dense cut pile which has strength and stability.

BRIEF DESCRIPTION OF DRAWINGS

FIGS. 1(*a*) through 1(*f*) illustrate the various stages of manufacture of the improved cut pile fabric resulting in the finished fabric of FIG. 1(*f*);

BEST MODE FOR CARRYING OUT THE INVENTION

Figures 1A, 1B, 1C, 1D, 1E, 1F, 2, 3, 4:
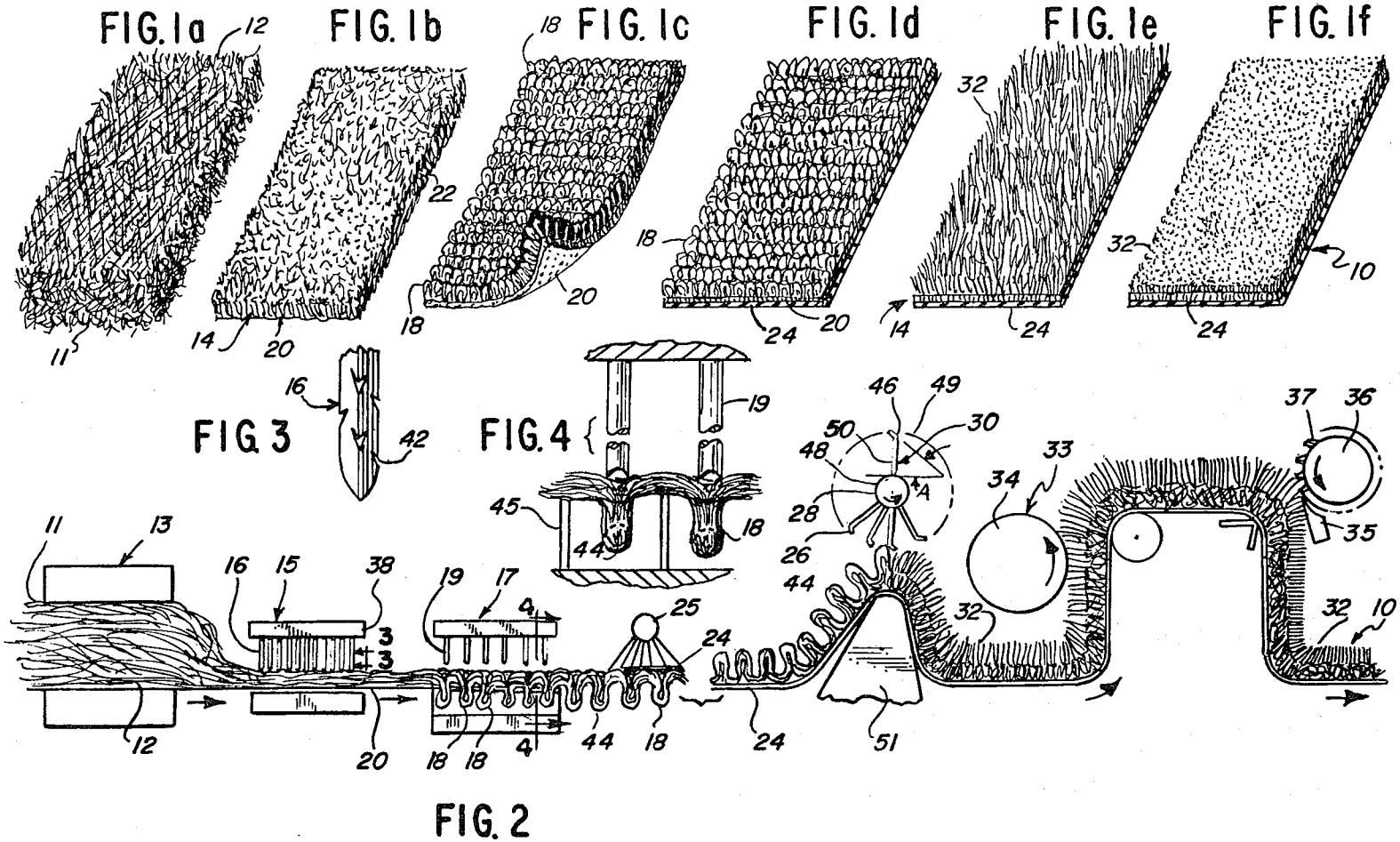
FIG. 2 illustrates a schematic fragmentary manufacturing line for practicing the method of the present invention to perform the various stages of manufacture of the fabric of FIGS. 1(*a*) through 1(*f*)
FIG. 3 is an enlarged view taken along line 3—3 of FIG. 2 of the needle of a needle loom.
FIG. 4 is an enlarged cross-sectional view of two adjacent texturizing needles taken along the line 4—4 of FIG. 2.

FIGS. 1(*a–f*) and 2 illustrate one preferred form of fabric 10 and the method of manufacturing same. Non-woven staple fibers 12 are laid up in a continuous web 11, as in FIG. 1(*a*), using, for instance, a conventional lapper 13, FIG. 2, whereupon as the web 11 is advanced past a needle loom 15, FIG. 2, it is needled into a continuous batt 14, FIG. 1(*b*), using conventional barbed needles 16, one of which is shown in enlarged fashion in FIG. 3. The batt 14 may be needled from both sides or from one side, as shown depending upon the materials of the fibers and the desired weight of the finished fabric. In a preferred form of the steps of manufacture, and assuming that the batt 14 was needled from one side only, which was from above in FIG. 2, the needled batt 14 is turned over or reversed before it is fed to a texturizing needle loom 17. The turning of the batt 14 may be accomplished by rolling the batt onto a roller (not shown) as it leaves the needle loom 15, after which the roller is reversed and the batt 14 is fed to the texturizing needle loom 17 so that the batt 14 is texturized from the side of the batt opposite to the single needle side. If the batt 14 was needled from both sides, it is fed to the texturizing needle loom 17 oriented so that the texturizing needles penetrate first into the first punched side so that the texturizing loops project from the last-punched side. The batt 14 is advanced past the texturizing needle loom 17 where it is texturized into loops 18. The texturizing needle loom 17 uses fork needles 19 which pass through one surface, such as a back surface 20, of the batt 14 to push fibers caught on the ends of the needles through another surface, such as a face surface 22, to form the texturized loops 18 extending from said face surface 22.

By texturized loops is meant a plurality of clusters of loops of fibers formed from a batt of non-woven stable fibers where each cluster contains a plurality of different sized loops of fibers. The loops of each cluster are formed by a forked needle open in the machine direction so that the loops of each cluster will have openings generally aligned in the cross-machine direction. As will be apparent in FIG. 1(*c*) and in FIG. 2 at loom 17, a plurality of cross-machine or crosswise rows of clusters of loops will be formed simultaneously while forming, as viewed in FIG. 4 which is a view transverse to FIG. 2, a plurality of columns of clusters of loops in the machine direction.

A backing 24, such as a coating of latex, FIG. 1(*d*), or the like, is applied to the back surface 20 using a conventional latex applicator 25 to lock the fibers 12 of the batt 14 and, in particular, the fiber ends of the loop 18 that are still in the batt and to add stiffness to the batt.

The applicator 25, as shown in FIG. 2, is a commercially available spray applicator which applies the backing 24 as the batt 14 is moved past the applicator with the backing surface facing upward. In place of the latex backing 24, when the nature of the material of the fibers in the batt 14 is thermoplastic, or the like, the back surface 20 may have the backing 24 formed by fusing (not shown) using an appropriate heat roll, or the like, which is intended to lock the ends of the fibers forming the loops and to add stiffness to the batt. The backing 24 gives strength and stability, as well as stiffness, to the finished fabric. In general, the latex backing 24 is used for high melt materials, such as nylon, acrylic, or the like, and the fused backing 24 is used with lower melt materials, such as polypropylene.

The texturized and backed batt 14 is then reversed or turned over so that the loops 18 project upward and the backing 24 faces downward. The batt 14 is moved through a tigering apparatus 26 where one or more tigering rolls 28 are rotated, preferably in the direction of movement of the batt 14, i.e. counterclockwise as the batt 14 moves to the right in FIG. 2, wherein a plurality of tigering wires 30 break, fracture or cut the texturized loops 18 to create a lofted, dense pile 32. The rolls 28 may rotate in a clockwise direction, as viewed in FIG. 2, without departing from the spirit of the invention. The batt 14 with the tigered pile is then moved past a polishing apparatus 33 having a polishing roll 34, FIG. 2, which will raise the pile to a more transverse orientation with respect to the batt 14 and will remove the crimps in the fibers adding depth to the pile. A preferred form of polishing apparatus 33 is shown in FIG. 2 with the polishing roll 34 addressing the batt 14 as the batt is moved vertically. The polishing apparatus 33 is mounted on the same frame as a shear 36 with the polishing apparatus 33 and shear 36 being synchronized for simultaneous operation. The polishing apparatus 33 and shear 36 are standard, commercially available pieces of equipment that are incorporated in the line of manufacture of the fabric. The batt 14 with the polished pile 32 is next moved past the shear 36 so that the shear 36 will shear or cut the pile 32 or the raised ends of the fibers to a uniform height above the plane of the batt 14.

More specifically, staple fibers 12 of polypropylene, nylon, polyester, or the like, of a length within the range of 2" to 4" and preferably about 3" long having a denier within the range of 6 to 60 preferably in the range of 6 to 20, are laid up in the lapper 13 to form the web 11 after which they are needled in the needle loom 15 to form the needled batt 14. The batt 14 will generally have a weight within the range of 6 ounces to 30 ounces per square yard. As shown, single needle board 38 supports an appropriate number of needles 16, one such needle 16 being shown in enlarged form in FIG. 3, which have barbs 42 for needle punching the fibers 12 together into the batt 14. It has been found that the minimum lengths of the fibers should not be below about 2" since shorter lengths reduce fabric strength and the quality of the finished product.

After turning the batt 14, the texturizing needle loom 17, having the fork ended needles 19, as shown enlarged in FIG. 4, texturizes the batt 14 by pushing clusters 44 of loops 18 of fibers 12 from the body of the batt. As shown in FIG. 4, the needles 19 have a fork shape which, in the present setup, have the openings in the fork running parallel to the direction of movement of the batt (the machine direction) so that the openings in the loops will extend across the direction of movement of the batt (the cross machine direction). As shown in FIG. 4, lamellas 45 are aligned in the machine direction and are fixed adjacent to the path of movement of each row of fork needles 19. The lamellas 45 are located on the opposite side of the batt 14 from the needles to provide support for the batt and to provide grooves for the formation of the clusters 44 of loops 18. Each cluster 44 contains plural loops 18 of different sizes due to the catching and pulling of different portions of individual fibers between adjacent side-by-side and front-to-rear clusters. The texturizing needle loom 17 is adjusted to push between 20% to 65% by weight of the fibers 12 from the batt 14 to form the loops with a more common percent being 35%. The height of the highest loops 18 above the face surface 22 is in the range of $\frac{1}{8}$" to $\frac{3}{4}$".

After texturizing, the batt 14 is provided with a backing 24. As illustrated, the backing 24 is a coating of latex applied by a spray applicator 25 after which the coating is dried in a conventional manner. A typical latex material is SBR (Styrene Butadiene Rubber), sold under the tradename DAREX by W. R. Grace Co. As an alternative, backing 24 may be a sintered polyethylene applied in conventional fashion onto the back surface 20 eliminating weight and cost of the latex while still providing fabric strength and moldability. As a second alternative, backing 24 may be a thin thermoplastic sheet laminated to the back surface 20 of the batt 14. The thermoplastic sheet could contribute to mold retention of the fabric, for instance, for a molded carpet for use on the floor of an automobile or truck. As another alternating backing 24, the back surface 20 may be fused to form the backing, assuming, that is, that the materials of the fibers are of a fusible nature. The purpose of the backing 24 is not only to back the fabric, but also to lock the fibers 12 in the batt 14 and, in particular, to lock as many of the ends of the fibers that have been formed into loops 18 as is possible. This affords the anchoring affect for the fibers of the loop 18 so that the tigering apparatus can sever the loops 18 as by breaking, fracturing or cutting. When the finished fabric is to be used in marine applications, the latex backing 24 may not be desirable due to its solvency in gasoline, and the like, and due to its flammability. Therefore, for marine or similar applications, a fused backing, or the like, is preferred.

The tigering apparatus 26 includes one or two tigering rolls 28 (only one being shown) which has a plurality of wires 30, each of which has a short distal contact portion 46 which extends at an angle A within the range of approximately 60° to 90° to a tangent to the cylindrical hub 48 drawn at the intersection of an extension of the portion 46 to said hub 48. The contact portion 46 may extend all the way from the hub 48 or may be connected at a bend or knee 49 to a proximal portion 50 of each wire 30. The tigering roll or rolls 28 rotate at speeds in the range of 500 to 1000 r.p.m. as the texturized batt 14 is advanced at a speed within the range of about 6 feet to 25 feet per minute. The cross-sectional shape of each wire 30 may be round, square, or rectangular and should be of a length to reach into the texturized clusters 44 to engage and break, fracture or cut approximately 90% of the loops 18. In alignment with each trigering roll 28 is a cloth rest 51 which is shaped and located relative to the tigering roll 28 in such a way that the loops 18 of the clusters 44 of the texturized batt 14, in passing over the rest 51, are presented to the wires 30 of the tigering roll 28 in an open exposed condition thereby affording the wires 30 a maximum pass at the loops 18 in the least compacted form of the loops. In this way, the wires 30 effectively break, fracture or cut the maximum number of fibers 12 of the loops 18 without fouling or breaking the wires. The spacing between the tips of the wires 30 and the surface of the rest 51 is adjusted according to the fabric construction. The wires 30 could be straight and angled to a tangent to the hub 48 at an angle within the range of 60° to 90°, however, applying a knee 49 or a curve in the wires 30 reduces vibration and eliminates shock and wire breakage. It is recognized that the ends of a few fibers 12 will not be sufficiently anchored by the other fibers in the needled batt 14 or by the backing 24 so that a few ends will be pulled from the batt 14, however, it is intended that as many as possible of the loops 18 will be broken, fractured or cut as foresaid.

The tigering roll or rolls 28 will produce a fabric having some lone, some intermediate, and some short fibers which will give a lofted, dense, but somewhat uneven, pile 32.

The polishing apparatus 33 will have at least one heated polishing roll 34 which will act on the fractured fibers 12 to remove the crimp in the fibers and to vertically orient the fibers relative to the batt. The polishing apparatus 33 can be any one of the commercially available types, such as a heated electrostatic polisher, which is rotated at speeds in the range of 500 to 1000 r.p.m. as the batt 14 is moved past the polisher at a speed within the range of 6 to 25 feet per minute. The temperature of the polisher is determined by the fiber type, polypropylene, for instance, requires a temperature of approximately 215° while polyester requires a temperature of approximately 300°. The polisher addresses the cut fibers of the batt 14 as the batt is moved vertically past the heated roller 34. The polisher will further increase the depth of the pile 32 and will elevate the fibers so that they approach the shear 36 at the most advantageous and most efficient angle. The blades 37 of the shear 36 are rotated in a counterclockwise direction past the shear plate 35 to cut or shear the ends of the fibers. Some fiber weight and height is lost during the shearing step, but this is unavoidable and does not affect the end product. The sheared batt 14 results in a cut pile fabric of exceptionally fine quality that is dense and plush.

EXAMPLE 1

A plurality of layers of non-woven staple fibers of 3" lengths of polypropylene was lapped into a continuous web 11 which was then needle punched from one side at a count of 1100 punches per square inch to form a continuous batt 14. The needle punched batt 14 was the turned over and was texturized from the opposite side on a texturizing needle loom 17 to form texturized clusters 44 of loops 18 with 35% of the fibers 12 of the batt 14 being punched through the face surface 22 to a height of ½". The fork needles 19 used on the texturizing needle loom 17 were 25 gauge—2½" length—0.30 mm spacing between points of the fork, which needles were oriented with the opening between the points of the fork disposed parallel to the machine direction. The textured batt 14 was then moved past spray applicator 25 whereupon a backing 24 of latex, identified as SBR, was applied on the back surface 20 at the rate of 8 ounces per square yard and was dried. The texturized and latexed batt 14 was then turned over and was passed at the rate of 15 feet per minute through a pair of tigering rolls 28 rotating at 780 r.p.m. in a counterclockwise direction to break, fracture or cut the loops 18. The tigering apparatus 26 was made by Polrotor Co. and was a PTM 240/II machine. The rolls 28 had 77 wires per square inch with the wires 30 being equally spaced apart and having a bent configuration presenting a distal portion 46, that extended at an angle of approximately 75% to a tangent to the base of the wire. A polishing apparatus made by Polrotor Co. and identified as a PRS/GF 260D, rotated at a speed of 960 r.p.m as the batt was moved past the roll 34 of the apparatus at 15 feet per minute. A Polrotor Co. shearing apparatus sheared the fibers to a height of ⅝" resulting in a dense and plush cut pile fabric 10. The fabric 10 may be dyed in conventional fashion or the fibers 12 may have been stock dyed or solution dyed the desired color so that the finished fabric would reflect that color.

Other aspects, objects and advantages of this invention can be obtained from a study of the drawings, the disclosure and the appended claims.

We claim:

1. A cut pile fabric comprising:

a needled batt of non-woven staple fibers, texturized loops of stable fibers formed from the staple fibers of said batt extend outwardly from one surface of the batt, the texturized loops of fibers are comprised of a plurality of clusters of loops of fibers with each cluster containing a plurality of different sized loops of fibers, backing means on another surface of said batt for securing fibers of said texturized loops to the fibers of said batt, a substantial portion of the fibers of said texturized loops being cut to form cut pile, and said cut pile being polished and sheared to provide a fabric with a plush cut pile.

2. A cut pile fabric as claimed in claim 1 wherein said staple fibers are selected from the group consisting of polypropylene, nylon and polyester.

3. A cut pile fabric as claimed in claim 1 wherein said staple fibers are of a length within the range of 2" to 4".

4. A cut pile fabric as claimed in claim 1 wherein said cut pile has a depth within the range of ⅛" to ¾".

5. A cut pile fabric comprising:

a needled batt of non-woven staple fibers having a face surface and a back surface, a plurality of clusters of loops of non-woven staple fibers formed from the fibers of said batt and projecting outwardly from said face surface of the batt, each cluster of loops containing a plurality of different sized loops of fibers, backing means on said back surface of the batt securing the fibers of said clusters of loops to the fibers of said batt, and a substantial portion of said loops being cut to form cut pile.

6. A cut pile fabric as claimed in claim 5 wherein said cut pile is polished to straighten and to orient the fibers of the pile.

7. A cut pile fabric as claimed in claim 6 wherein said polished cut pile is sheared to provide a uniform pile depth.

8. A method of manufacturing a cut pile fabric comprising the steps of:

lapping and needling non-woven staple fibers into a batt, forming from the staple fibers of said batt texturized loops of fibers projecting from one surface of the batt, with the loops being formed in clusters which are aligned in the cross-machine direction and in the machine direction, applying a backing on another surface of the batt for securing the stable fibers of said texturized loops to said batt, tigering said texturized loops to cut a substantial portion of said loops to form cut pile, polishing said cut pile to straighten the pile and to orient the cut pile in a transverse direction with respect to said batt, and shearing said cut pile to a predetermined pile height.

9. A method of manufacturing a cut pile fabric comprising the steps of:

lapping and needling non-woven stable fibers to form a batt, texturizing said batt to form a plurality of clusters of loops of fibers from the fibers of said batt and projecting from one surface of the batt, each cluster having a plurality of different sized loops of fibers, applying a backing on another surface of the batt for stiffening said batt and for securing the staple fibers of said loops to said batt, and cutting a substantial portion of said loops to form cut pile on the batt.

10. A method of manufacturing a cut pile fabric as claimed in claim 9 wherein said cut pile is polished to remove crimps and to orient said cut pile in a direction transverse to the plane of said batt.

11. A method of manufacturing a cut pile fabric as claimed in claim 10 wherein said polished cut pile is sheared to a predetermined pile height.

12. A method of manufacturing a cut pile fabric comprising the steps of:

lapping and needling non-woven staple fibers into a batt, texturizing between 20% and 65% by weight of said batt on a texturizing needle loom to form a plurality of clusters of loops of fibers projecting from one surface of the batt, each cluster having a plurality of loops of different sizes, applying a backing selected from the group consisting of latex, sintered polyethylene, thermoplastic sheeting or fushion to another surface of the batt for stiffening said batt and for securing the staple fibers of said clusters of loops to said batt, tigering said clusters of loops of fibers by cutting a substantial portion of said loops to form cut pile, polishing said cut pile to orient said cut pile transversely with respect to said batt, and shearing said last-named individual fibers to a predetermined pile height.

* * * * *

UNITED STATES PATENT AND TRADEMARK OFFICE

CERTIFICATE OF CORRECTION

PATENT NO. : 4,391,866

DATED : July 5, 1983

INVENTOR(S) : Robert C. Pickens, Reese R. Thomas, Ronald Somerville

It is certified that error appears in the above-identified patent and that said Letters Patent is hereby corrected as shown below:

Column 1, line 12, delete "stable" and substitute therefor --staple--

Column 1, line 33, delete "stable" and substitute therefor --staple--

Column 1, line 40, delete "stable" and substitute therefor --staple--

Column 2, line 52, delete "stable" and substitute therefor --staple--

Column 5, line 15, delete "foresaid" and substitute therefor --aforesaid--

Column 5, line 50, delete "the" and substitute therefor --then--

Column 6, line 10, delete "5/8" and substitute therefor --3/8--

Column 7, line 4, delete "stable" and substitute therefor --staple--

Column 7, line 14, delete "stable" and substitute therefor --staple--

Signed and Sealed this

*Twentieth* Day of *September 1983*

[SEAL]

*Attest:*

GERALD J. MOSSINGHOFF

*Attesting Officer*

*Commissioner of Patents and Trademarks*

Disclaimer 4,391,866.—*Robert C. Pickens, Jr.*, Gurnee; *Reese R. Thomas*, Libertyville and *Ronald Somerville*, Gurnee, all of Ill. CUT PILE FABRIC WITH TEXTURIZED LOOPS. Patent dated July 5, 1983. Disclaimer filed Feb. 4, 1984, by the assignee, *Ozite Corp.*

The term of this patent subsequent to June 21, 2000 has been disclaimed.

[*Official Gazette April 10, 1984.*]